US012635789B2

(12) United States Patent
Byrne

(10) Patent No.: US 12,635,789 B2
(45) Date of Patent: May 26, 2026

(54) HEALTHCARE PROVIDER PORTABLE WORKSTATION

(71) Applicant: MAINE MEDICAL CENTER, Portland, ME (US)

(72) Inventor: James Byrne, Topsham, ME (US)

(73) Assignee: Maine Medical Center, Portland, ME (US)

( * ) Notice: Subject to any disclaimer, the term of this patent is extended or adjusted under 35 U.S.C. 154(b) by 311 days.

(21) Appl. No.: 18/243,855

(22) Filed: Sep. 8, 2023

(65) Prior Publication Data

US 2024/0081522 A1 Mar. 14, 2024

Related U.S. Application Data

(60) Provisional application No. 63/404,707, filed on Sep. 8, 2022.

(51) Int. Cl.
*A47B 3/10* (2006.01)
*A45C 5/14* (2006.01)
(Continued)

(52) U.S. Cl.
CPC ..... *A47B 3/10* (2013.01); *A45C 5/14* (2013.01); *A45C 9/00* (2013.01); *A45C 13/262* (2013.01);
(Continued)

(58) Field of Classification Search
CPC .. A47B 3/10; A47B 9/20; A47B 13/00; A47B 37/00; A45C 5/14; A45C 13/28
(Continued)

(56) References Cited

U.S. PATENT DOCUMENTS 6,578,708 B2 6/2003 Barnett
6,736,073 B2 * 5/2004 Ryburg ..... A47B 23/04 108/42
(Continued)

FOREIGN PATENT DOCUMENTS

CN 205126687 U 4/2016
CN 215504007 U 1/2022
KR 101674369 B1 11/2016

OTHER PUBLICATIONS

International Search Report, PCT/US2023/032267, Dec. 26, 2023, pp. 1-4.

*Primary Examiner* — Don M Anderson
*Assistant Examiner* — Justin Caudill
(74) *Attorney, Agent, or Firm* — Armis IP Law, LLC

(57) ABSTRACT

A portable home healthcare workstation defines a wheeled enclosure and telescoping, angled worksurface transportable to a patient home or domicile bedside. A telescoping handle extends for supporting the worksurface at a suitable height, and an angular pivot allows the worksurface to be oriented for ease of access to patient records or temporary storage of medical supplies. An accessory container attaches to the telescoped uprights and provides containment of equipment and supplies, and detaches for storage in the enclosure. A stabilizer extends horizontally from the uprights, and together with the attached enclosure and base provide support on opposed sides of the uprights for maintaining a substantially vertical orientation to support the worksurface. Retraction of the stabilizer allows the worksurface to be received in the enclosure for wheeled portability, and collapsing of the telescoped uprights allows for handcarry capability.

18 Claims, 12 Drawing Sheets

(51) Int. Cl.

| | |
|---|---|
| ***A45C 9/00*** | (2006.01) |
| ***A45C 13/26*** | (2006.01) |
| ***A45C 13/28*** | (2006.01) |
| ***A47B 9/20*** | (2006.01) |
| ***A47B 13/00*** | (2006.01) |
| ***A47B 37/00*** | (2006.01) |

(52) U.S. Cl.
CPC ..... *A45C 13/28* (2013.01); *A47B 9/20* (2013.01); *A47B 13/00* (2013.01); *A47B 37/00* (2013.01); *A45C 2013/267* (2013.01); *A47B 2200/0051* (2013.01); *A47B 2200/0086* (2013.01)

(58) Field of Classification Search
USPC ..... 190/11, 18 R, 18 A
See application file for complete search history.

(56) References Cited

U.S. PATENT DOCUMENTS 7,278,644 B2 * 10/2007 Villarreal ..... A47B 21/00 312/249.8
7,445,216 B1 * 11/2008 Chou ..... B62B 1/142 280/638
7,593,222 B2 * 9/2009 Zbikowski ..... G06F 1/1628 206/320
7,946,609 B2 * 5/2011 Johnson ..... A45C 9/00 280/655
8,613,349 B1 * 12/2013 Halko ..... A45C 9/00 280/37
8,919,508 B1 * 12/2014 Halko ..... A45C 9/00 280/37
9,498,055 B2 11/2016 Distefano
10,173,315 B2 1/2019 Giamanco et al.
2001/0032765 A1 * 10/2001 Tiramani ..... A45C 3/001 190/115
2011/0029960 A1 2/2011 Cimadamore et al.
2012/0212116 A1 * 8/2012 McRorie ..... A61B 50/13 312/249.13
2013/0032443 A1 * 2/2013 Soedomo ..... A45C 9/00 190/11
2013/0292221 A1 * 11/2013 Ryan ..... A45C 13/262 190/115
2015/0298717 A1 10/2015 Uttley et al.
2016/0113388 A1 * 4/2016 Distefano ..... A45C 5/14 108/41
2022/0081117 A1 * 3/2022 Alam ..... B64D 11/0642

* cited by examiner

HEALTHCARE PROVIDER PORTABLE WORKSTATION

RELATED APPLICATIONS

This patent application claims the benefit under 35 U.S.C. § 119(e) of U.S. Provisional Patent App. No. 63/404,707, filed Sep. 8, 2022, entitled "HEALTHCARE PROVIDER PORTABLE WORKSTATION," incorporated herein by reference in entirety.

BACKGROUND

Home healthcare providers travel to a patient location for administration of on-site diagnostics and treatment of appropriate medical care. Many routine tasks need not be performed in a facility or doctor's office, but rather may be more efficiently administered by a clinician or nurse equipped with a small number of minimally invasive devices. Diagnostic measurements such as pulse, blood pressure (BP), temperature, blood draws, as well as non-invasive or minimally invasive treatment involving oral, topical, hypodermic needle based mediums, urinary catheter or ostomy care are often provided with common devices and accessories.

SUMMARY

A portable home healthcare workstation defines a wheeled enclosure and telescoping, angled worksurface transportable to a patient home or domicile bedside. A telescoping handle extends for supporting the worksurface at a suitable height, and an angular pivot allows the worksurface to be oriented for ease of access to patient records or temporary storage of medical supplies. An accessory container attaches to the telescoped uprights and provides containment of equipment and supplies, and detaches for storage in the enclosure. A stabilizer extends horizontally from the uprights, and together with the attached enclosure and base provide support on opposed sides of the uprights for maintaining a substantially vertical orientation to support the worksurface. Retraction of the stabilizer and collapsing of the telescoped uprights allows the worksurface and accessory container to be received in the enclosure for wheeled portability.

Configurations herein are based, in part, on the observation that conventional onsite medical care presents the caretaker with an unknown and sometimes suboptimal environment for conducting care procedures. Unfortunately, conventional approaches to caretaker accommodation is such that accessibility, working space, and appurtenant fixtures such as tables and chairs may or may not be available. Caretakers may be compelled to provide care functions in tight, confined spaces with little working area for temporary placement of needed devices and supplies. The need for sterility in patient contact and maintaining separate sterile and non-sterile regions further compounds challenges of a limited working space.

It would be beneficial to provide a portable, rolling utility bag with several integrated features including a laptop stand, a detachable storage unit, and a stabilization method for the bag that prevents the entire bag and associated apparatus from tipping over and minimize tripping hazards. The disclosed device implements a folding laptop stand, or worksurface, with hooks that allow the hanging of commonly used clinician equipment such as a stethoscope and a blood pressure cuff. The stand is mounted to the telescoping handle with specifically adapted hardware. Secondly, a detachable containment box can be deployed and attached to the telescoping arms when extended for use as a laptop stand. Lastly, a 3D printed conveyance vehicle and frame engages the bag for mobility. The frame stiffens the bag, allows for a secondary set of wheels, stationary feet, and serves as a mounting location for a stabilizer. The stabilizer has an appearance of a kickstand and is designed to be a collapsible, low profile extension of the frame, providing stability while minimizing tripping risks, a common hazard in confined work areas.

Accordingly, configurations herein substantially overcome the shortcomings of conventional approaches by providing a portable, self-contained workstation including storage of necessary supplies, devices and documentations in a compact enclosure, and telescoping supports for supporting a workstation surface, supply containment, and a retractable stabilizer for maintaining the telescoping members in an upright orientation. The enclosure may rely on wheeled transport, or alternately on attached handle straps, backpack straps or shoulder straps.

In further detail, the disclosed approach deploys a healthcare provider portable workstation system including a pair of collapsible, elongated members having proximate and distal ends, and a laptop worksurface hingedly attached to the proximate end. A conveyance vehicle attaches at the distal end of the upright elongated members. A retractable stabilizer at the distal end is adapted for extending a stabilizing horizontal member for maintaining a substantially vertical orientation of the elongated members. A containment has a detachable engagement to the elongated member, such that the containment, when engaged with the elongated member, allows noninterfering hinged movement of the worksurface. An enclosure disposed on the conveyance vehicle is sized for receiving the worksurface and the containment when the elongated member is in a collapsed orientation, for encapsulating the entire device and equipment.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Depicted below are several examples of the healthcare provider portable workstation device; other and alternate configurations may be apparent without deviating from the core concept.

Figure 1:
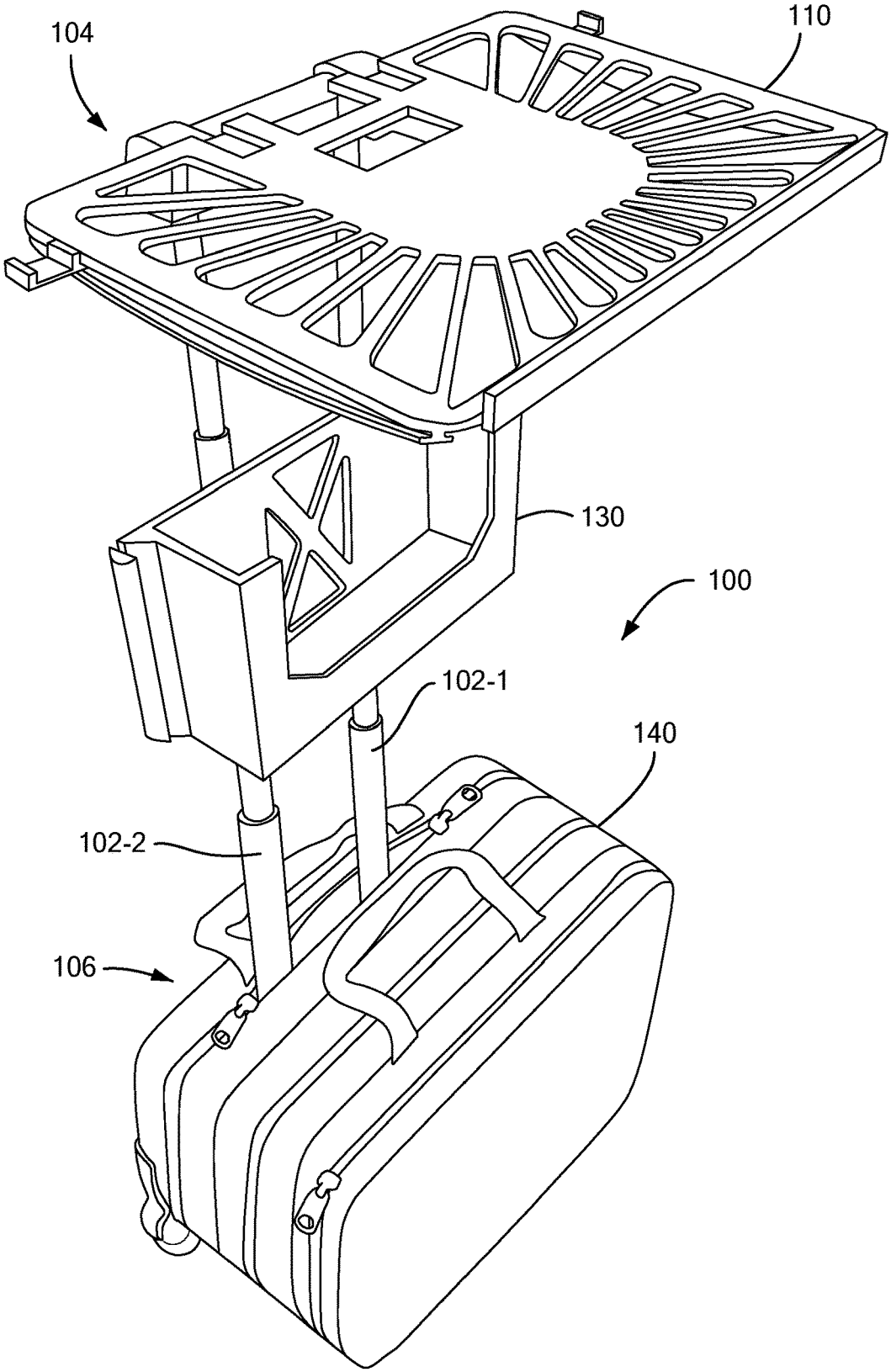
FIG. 1 shows a front perspective view of the portable, self-contained medical workstation.

FIG. 1 shows a front perspective view of the portable, self-contained medical workstation. In a particular configuration of FIG. 1, the healthcare provider portable workstation device 100 (workstation) includes at least one collapsible, elongated member 102-1 . . . 102-N (102 generally) having proximate 104 and distal 106 ends, typically forming a pair of telescoping uprights 102 joined by a handle 161 that provide vertical support. A worksurface 110 hingedly attaches to the proximate end 104. An enclosure 140 is configured for receiving the worksurface 110 when the elongated member 102 is in a collapsed orientation and telescopes down to dispose the worksurface 110 in the enclosure 140. The enclosure 140 is expected to be a flexible, soft sided containment for storage of medical equipment and accessories, as discussed further below.

Figure 2A:
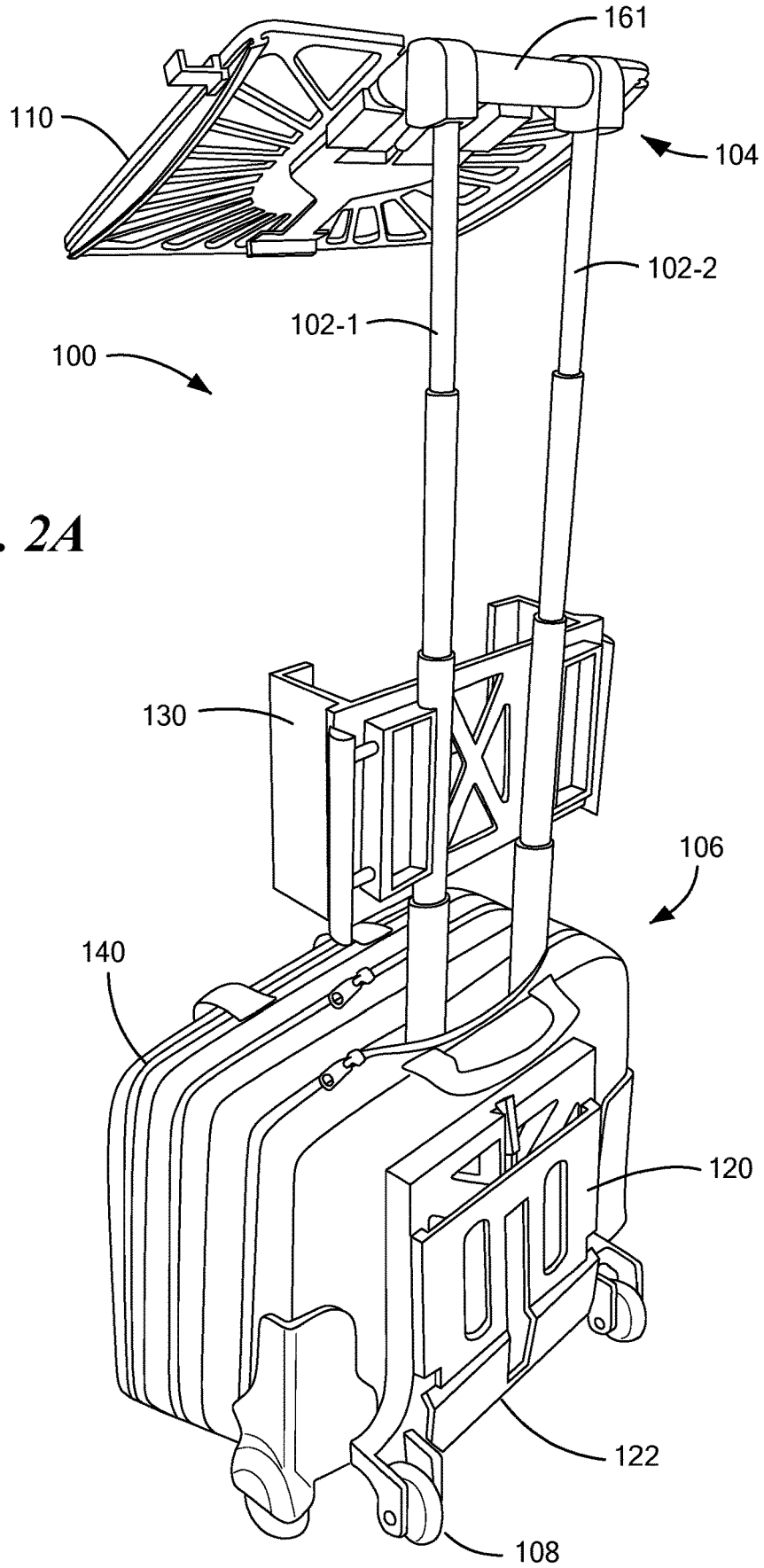
FIGS. 2A-2C shows rear perspective, top and bottom views of the workstation of FIG. 1.
Figure 2C:
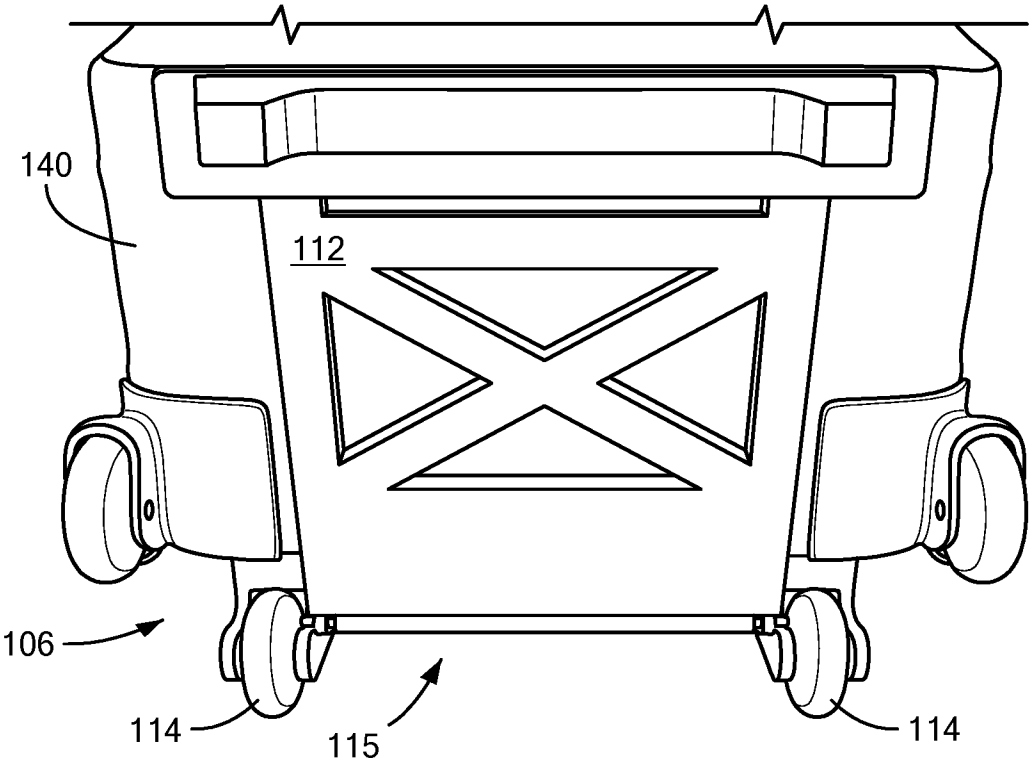
Figure 2B:
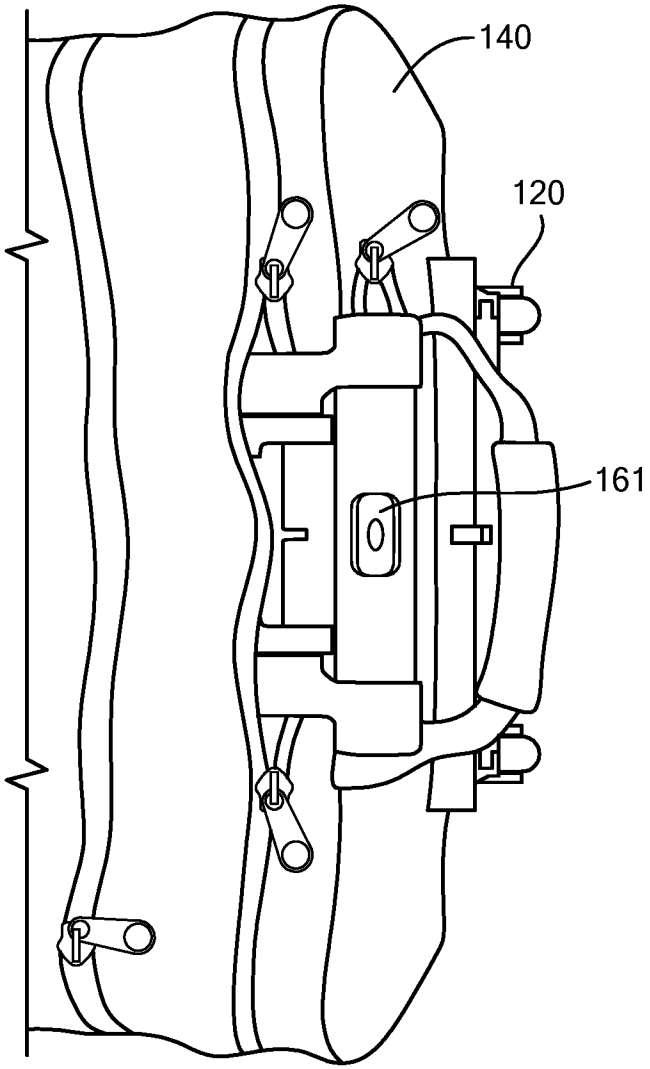

FIGS. 2A-2C show rear perspective, top and bottom views of the workstation of FIG. 1. Referring to FIGS. 1 and 2A-2C, a conveyance vehicle 108 such as a base 112 and wheels 114 attaches at the distal end 106 and form a frame 115 supporting the enclosure 140. A retractable stabilizer 120 attaches at the distal end 106, and is adapted for extending a stabilizing horizontal member 122 for maintaining a substantially vertical orientation of the elongated member(s) 102.

Figure 3A:
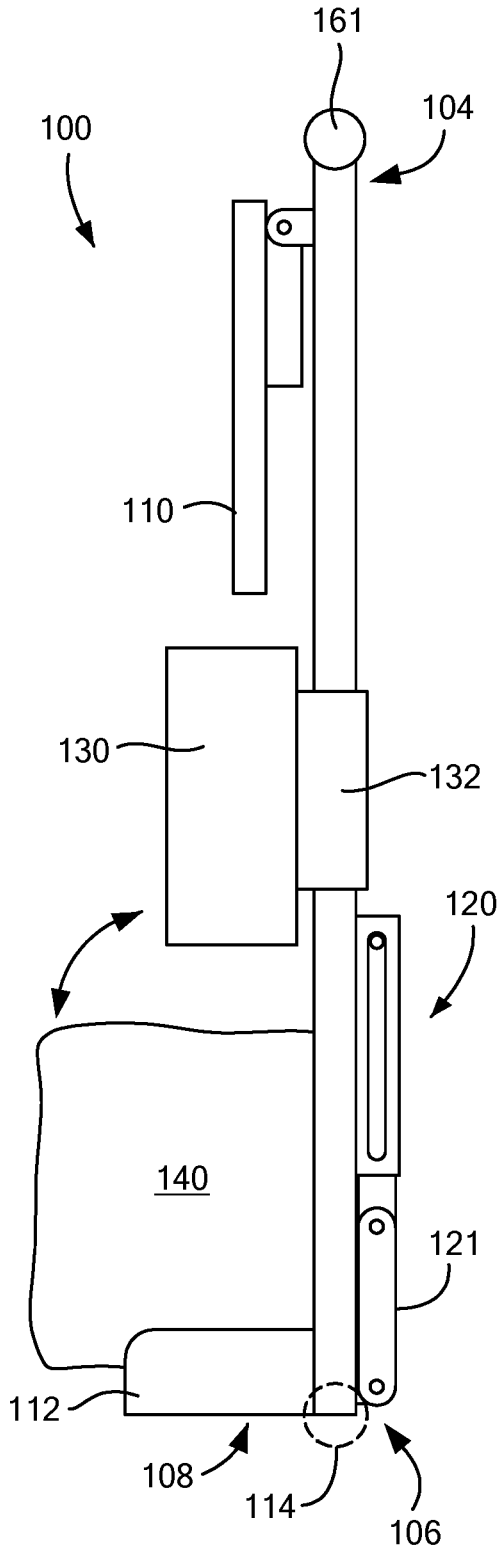
FIGS. 3A-3C—show schematic views of side elevations of workstation components in various degrees of deployment.
Figure 3B:
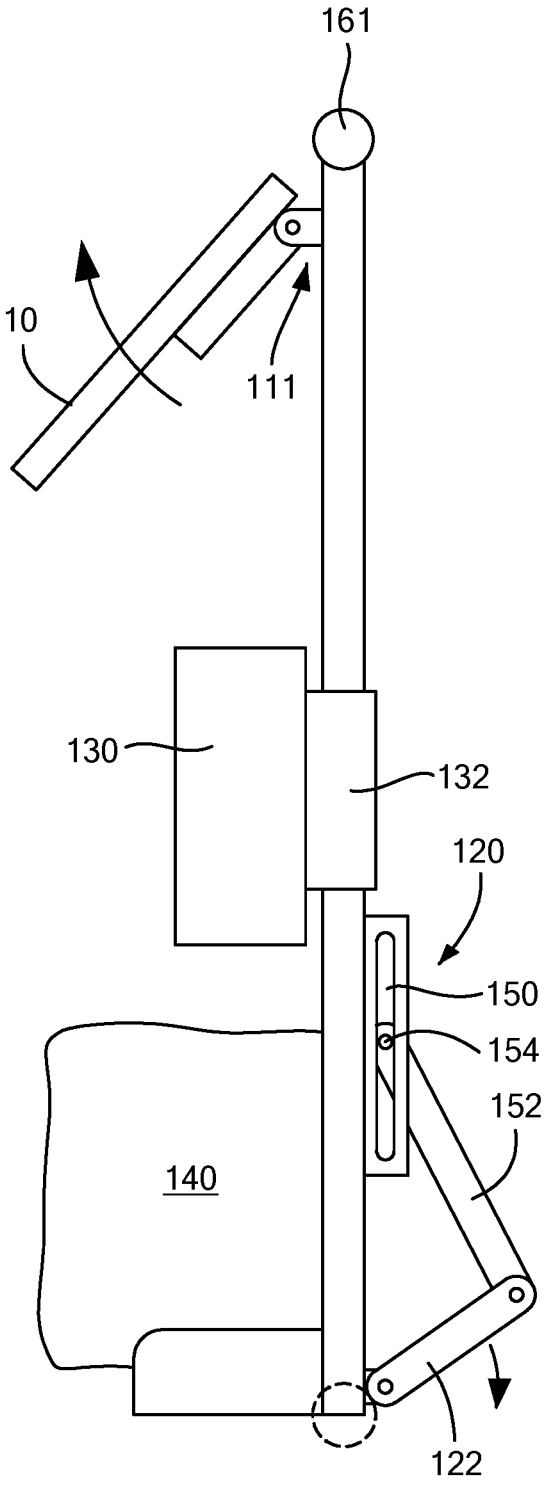
Figure 3C:
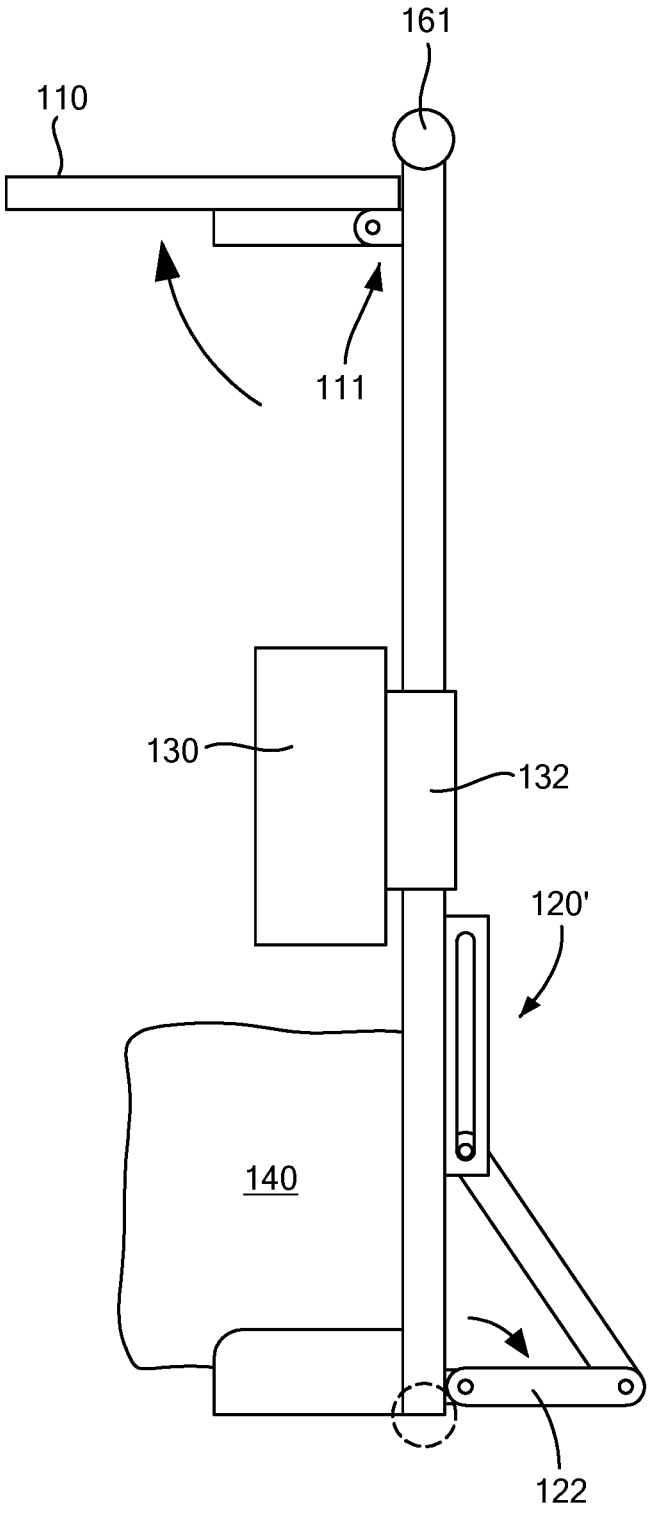
Figure 4A:
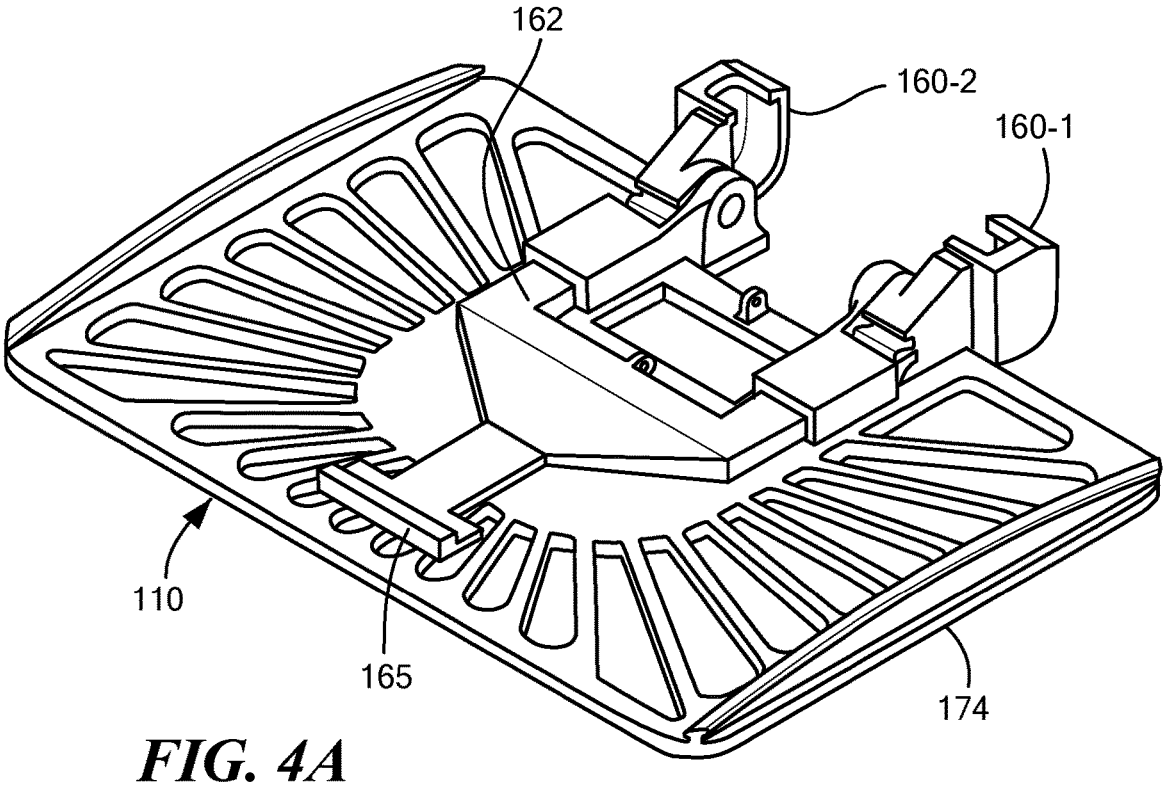
FIGS. 4A-4G show the worksurface of FIG. 1 adapted for laptop usage in various degrees of deployment.
Figure 4B:
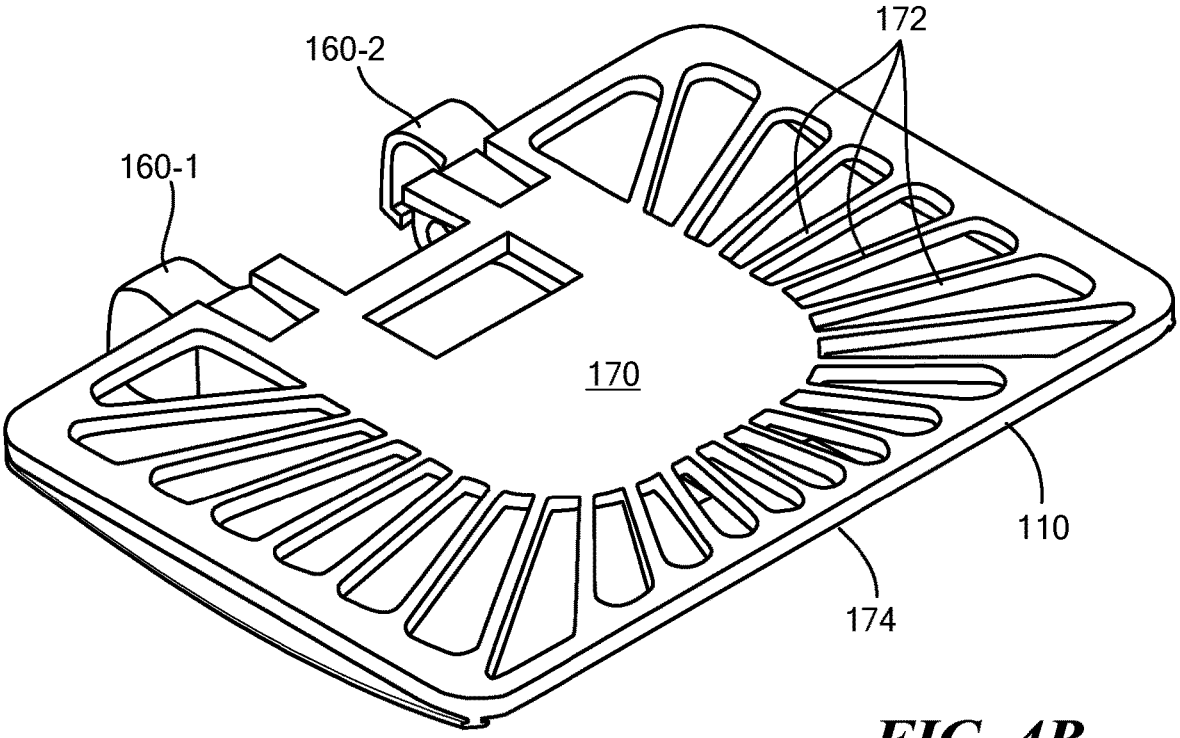
Figure 4C:
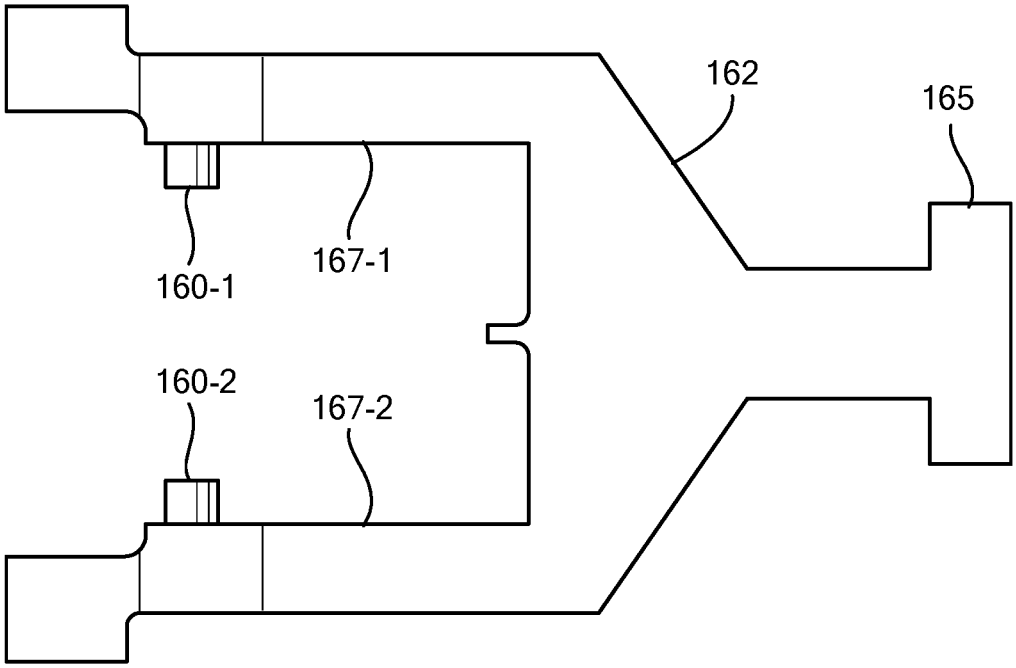
Figure 4D:
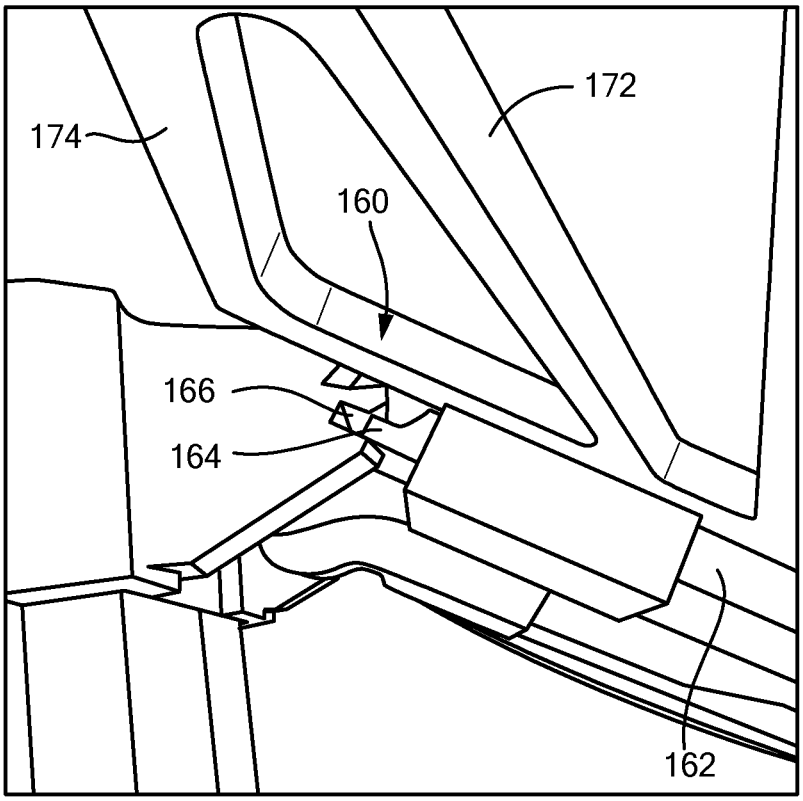
Figure 4E:
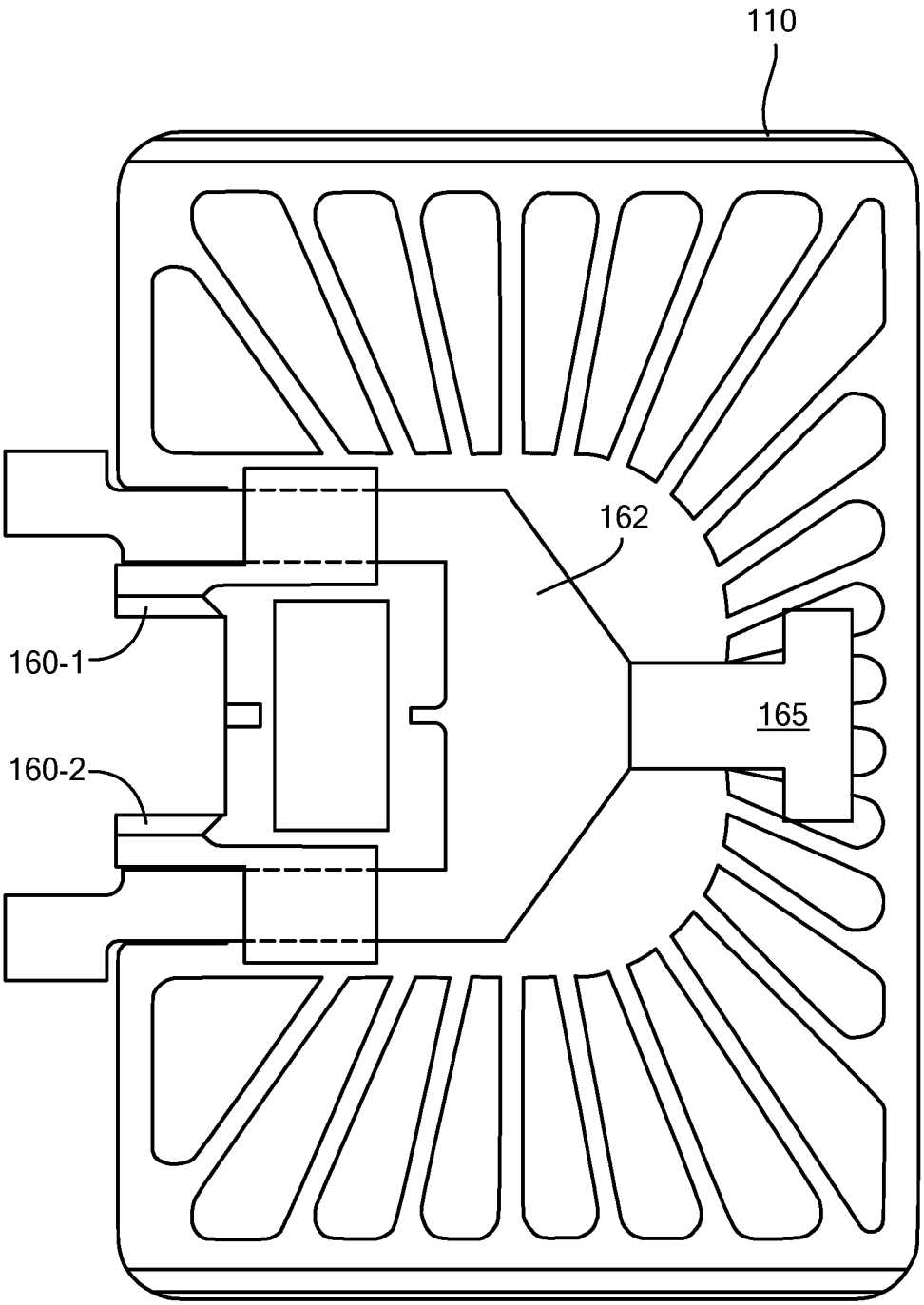
Figure 4F:
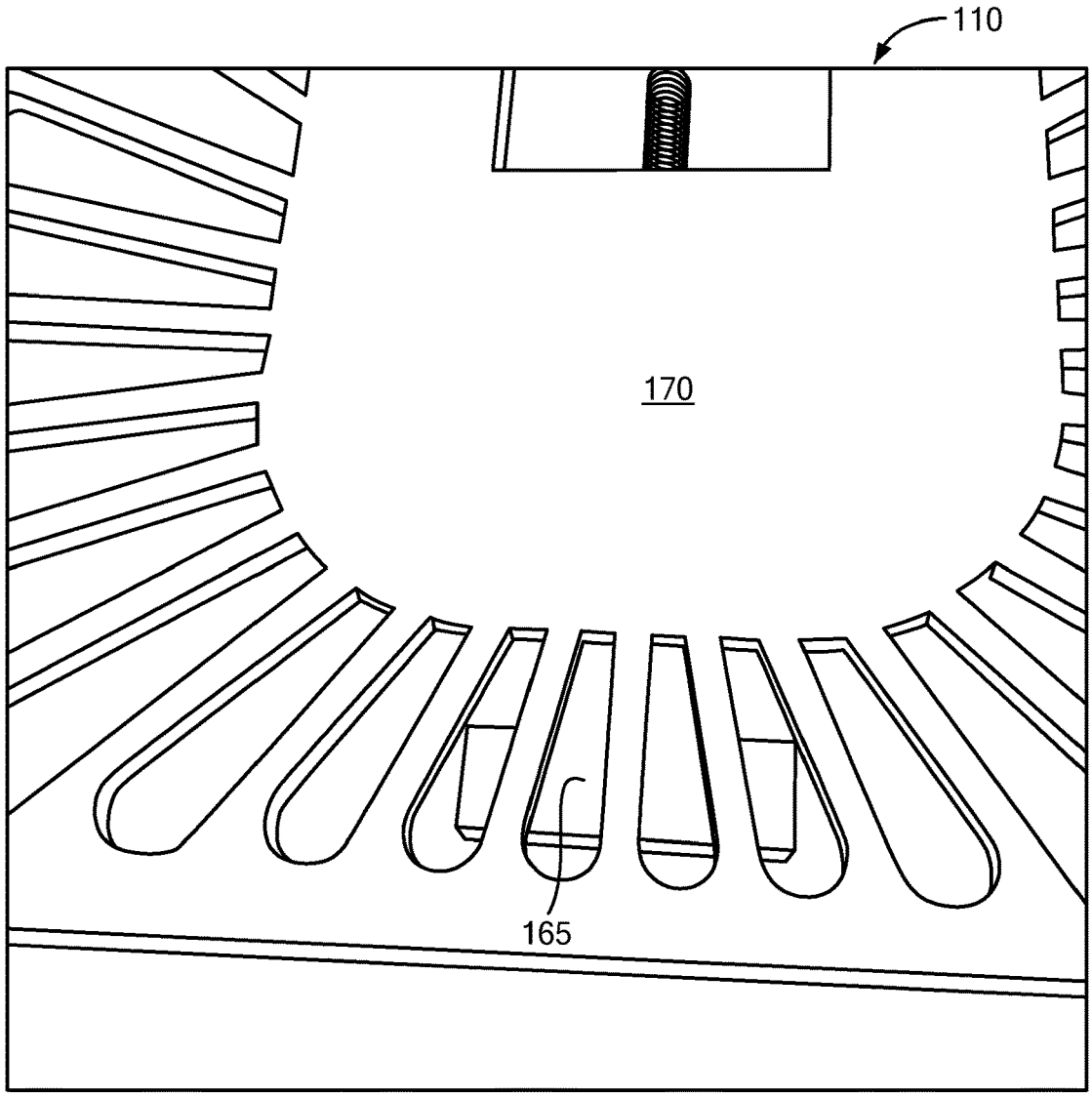
Figure 4G:
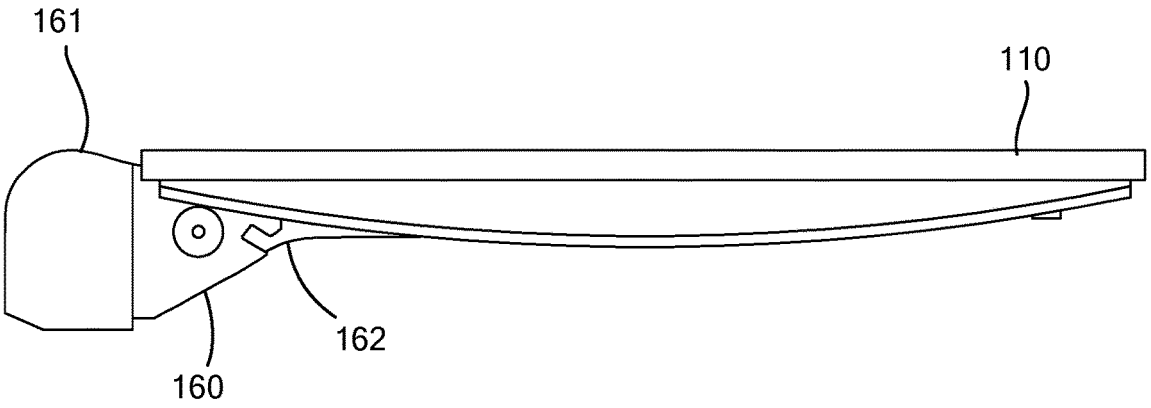

FIGS. 3A-3C show schematic views of side elevations of workstation components in various degrees of deployment. A paramount feature of the overall device is stable containment of the healthcare worker's needed equipment in a stable and accessible form while in enclosed, often unpredictable environments. Tripping hazards are of utmost concern. Generally, the enclosure 140 and stabilizer 120 are disposed on opposed sides of the elongated member 102 such that the horizontal member 122 extends perpendicular to the extended elongated member 102. The base 112 and horizontal member 122 therefore flank both sides of the telescoping uprights 102 for support and stability of the worksurface 110 and other materials stored thereon.

A containment 130 integrated with a detachable engagement 132 to the elongated member is sized for storage in the enclosure 140 for transport. The containment 130 is located such that, when engaged with the elongated members 102, allows noninterfering hinged movement of the worksurface for folding down. The engagement may take the form of a frictional or deformable clamp partially wrapping around an annular surface of the uprights 102. The enclosure 140 is sized for accommodating both the detached containment 130 and the folded worksurface 110 therewithin.

The worksurface 110 includes an adjustable angular attachment 111 to the elongated member, such that the angular attachment is adjustable between a vertical orientation parallel to the elongated member and a horizontal orientation perpendicular to the elongated member. The angular attachment may include a rotatable threaded member for fixing an angular orientation of the worksurface relative to the elongated member, to allow pivotal movement to a horizontal orientation. Other fixation approaches for angular attachment 111, such as a spring loaded engagement, may also be provided.

The stabilizer 120 further includes a slot 150 extending along the elongated member 102, and a restraint 152 having a pin 154 slidably engaged in the slot 150. The horizontal member 122 is established from downward movement of the pin 154 to angle a pivoting outrigger 121 articulated to the restraint 152. The pivoting outrigger 121 is rotatably attached to the distal end 106 and to the restraint 152 for pivotal movement to a horizontal position 122' in response to downward movement of the restraint and the pin traveling in the slot, defining a deployed stabilizer 120' based on extension of the horizontal member 122.

The constituent components of the disclosed device include the worksurface, containment, wheeled frame and stabilizer, and the enclosure for encapsulating these components and other practitioner's equipment employed in onsite medical encounter, now discussed in further detail.

FIGS. 4A-4G show the worksurface of FIG. 1 adapted for laptop usage in various degrees of deployment. The worksurface 110 is anticipated to operate primarily as a laptop stand, designed to support common laptops and tablets in the field of in-home health care. It locks into place via a ratcheting or similar mechanism, allowing multiple angles for various sitting and standing comfort for the provider. A handle 165 on the underside of the worksurface 110 is used to fold and unfold the worksurface 110 is spring loaded, and accessible from a natural hand position one would have while extending the telescoping elongated members 102. Hanging hooks may be added to the edges of the stand for the provider to temporarily store equipment vital to their protocols, such as stethoscopes and blood pressure cuffs. When folded, the stand fits into the same enclosure 140 into which the telescoping elongated members are collapsed.

Referring to FIGS. 1-4G, the worksurface 110 has a noncontinuous construction using a hub 170 and spokes 172 extending to a perimeter 174. The spokes 172 decrease the weight and avoid accumulation of spills, as well as allow for ample ventilation for a laptop resting on the flat surface. Referring specifically to FIG. 4D, the adjustable angular attachment includes a retractable protrusion 164 and a plurality of receptacles 166, such that each receptacle 166 of the plurality of receptacles correspond to an angular setting. The worksurface 110 has hinges 160-1 . . . 160-2 (160 generally) that engage the handle 161 joining the elongated members 102 at the proximate (upper) end 104. The retractable protrusion 164 extends from a positioning member 162, which is slidably attached to an underside of the worksurface 110, beneath the laptop surface. The positioning member 162 is spring loaded and actuated by a handle 165 for drawing the protrusions 164 out of and into engagement with the receptacles 166 as the worksurface 110 is tilted, typically between a horizontal position and an angled slope of about 30-45 degrees, as in FIG. 2A. A lip on the downward edge may assist keeping a laptop from sliding off in the angled position. An alternate clamping structure may engage the laptop from the sides for securing the laptop to the worksurface. The worksurface of course lowers to a vertical orientation for storage in the enclosure by releasing the positioning member 162.

In the example configuration the retractable protrusion 164 is spring biased by the positioning member 162, however in alternate configurations, the retractable protrusion may also engage a threaded member for advancement and retraction of the protrusion 164 with a receptacle 166 of the plurality of receptacles. In such a configuration, the angular attachment includes a rotatable threaded member for fixing an angular orientation of the worksurface 110 relative to the elongated member 102. Typically, a hinge 160 flanks each outer side of the elongated members 102, thus engaging the handle 161 between the elongated members 102. Each hinge has a set of the receptacles 166 for each angular position, and aligned with an opposed set of receptacles on the opposed hinge 160-2. Therefore, each angular position corresponds to a pair of aligned receptacles, each engageable by a protrusion 164 on a prong 167-1 . . . 167-2 of the positioning member 162.

Figure 5B:
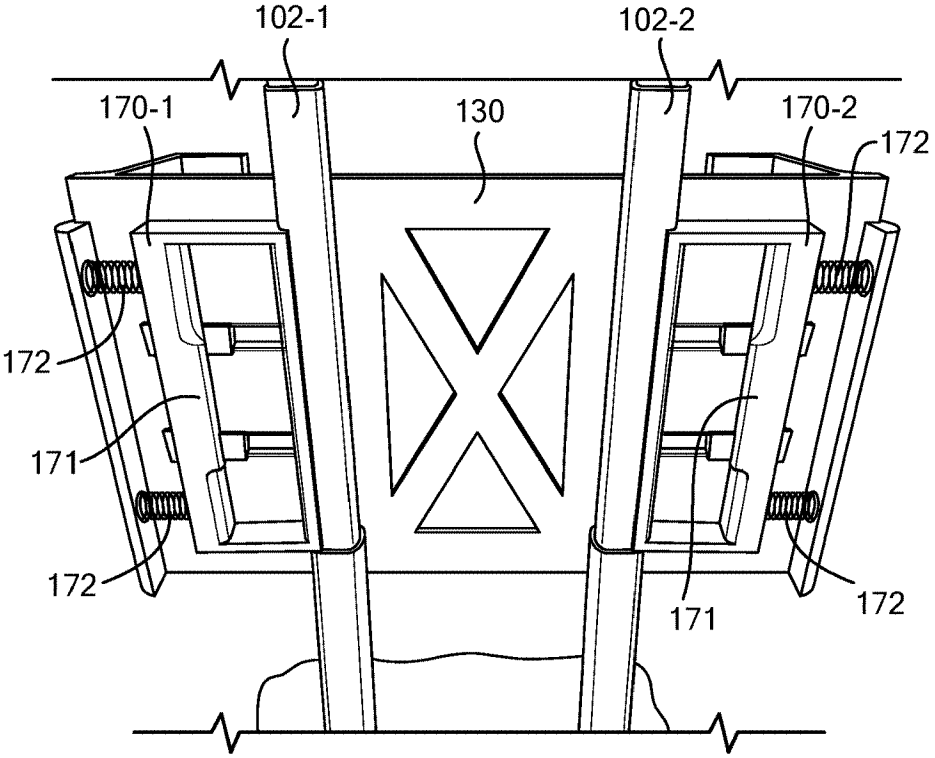
FIGS. 5A-5B show the containment of FIG. 1.
Figure 5A:
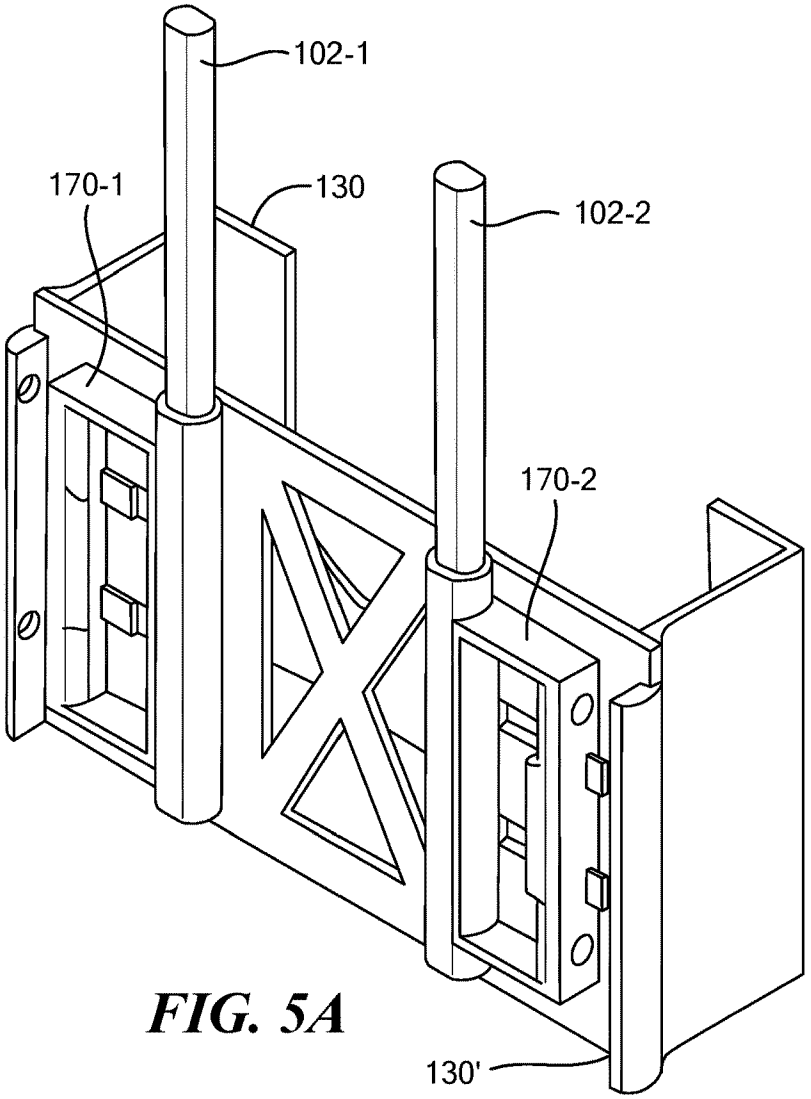

FIGS. 5A-5B show the containment of FIG. 1. Referring to FIGS. 1-5B, the containment 130 is a detachable storage space for various medical equipment. The containment 130 is a multipurpose box or bag type container. It can be loaded with necessities prior to a visit, and can be stored in this readied state in one of the bag's existing storage compartments. Two spring loaded handles allow the provider to clamp the containment 130 at multiple heights to the telescoping elongated members 102 after the laptop stand is deployed. This clamping mechanism also serves to stiffen the telescoping rods, adding stability to the system.

In operation, it fits inside the enclosure 140 and is intended to be removed and physically engaged to the elongated members 102 (uprights) via a spring loaded clamping force. Detachable engagement of the containment 130 includes a pair of opposed compression members 170-1 . . . 170-2 (170 generally) biased for frictional engagement with a corresponding pair of the elongated members 102-1 . . . 102-2. The compression members 170 are slidably attached to a rear side 130' of the containment and biased in an opposed direction by respective springs 172. Operation involves spreading the compression members 170 via handles 171 to compress the springs 172 and release engagement with the elongated members 102.

Figure 6B:
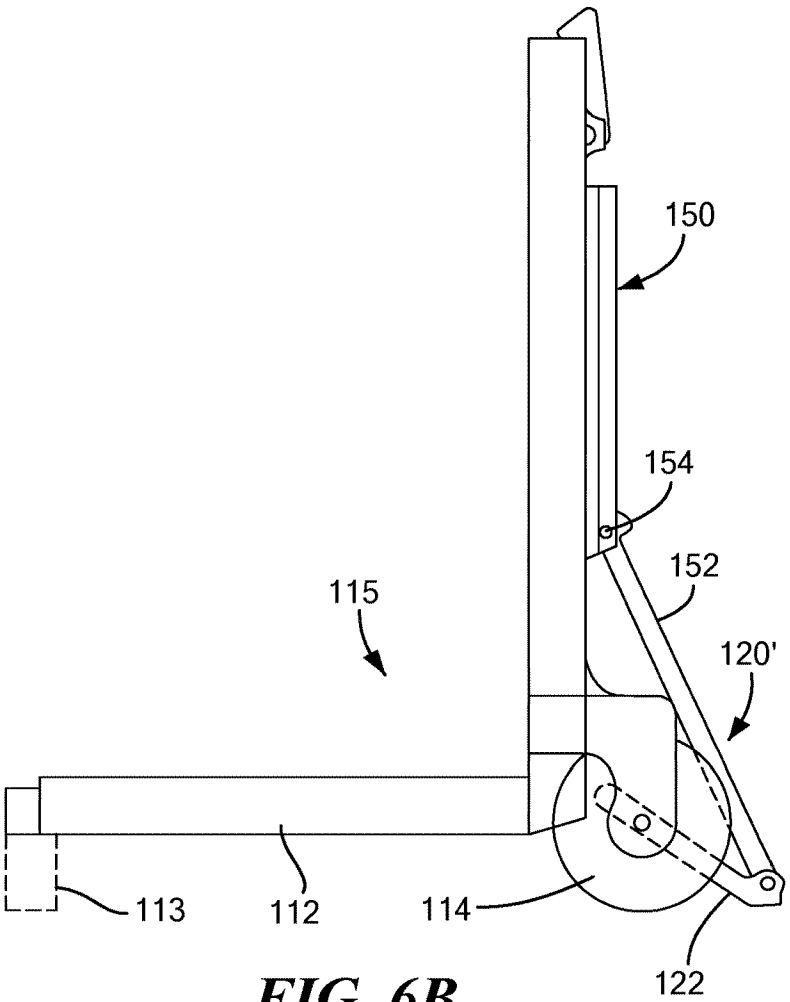
FIGS. 6A-6B show the retractable stabilizer in deployed positions.
Figure 6A:
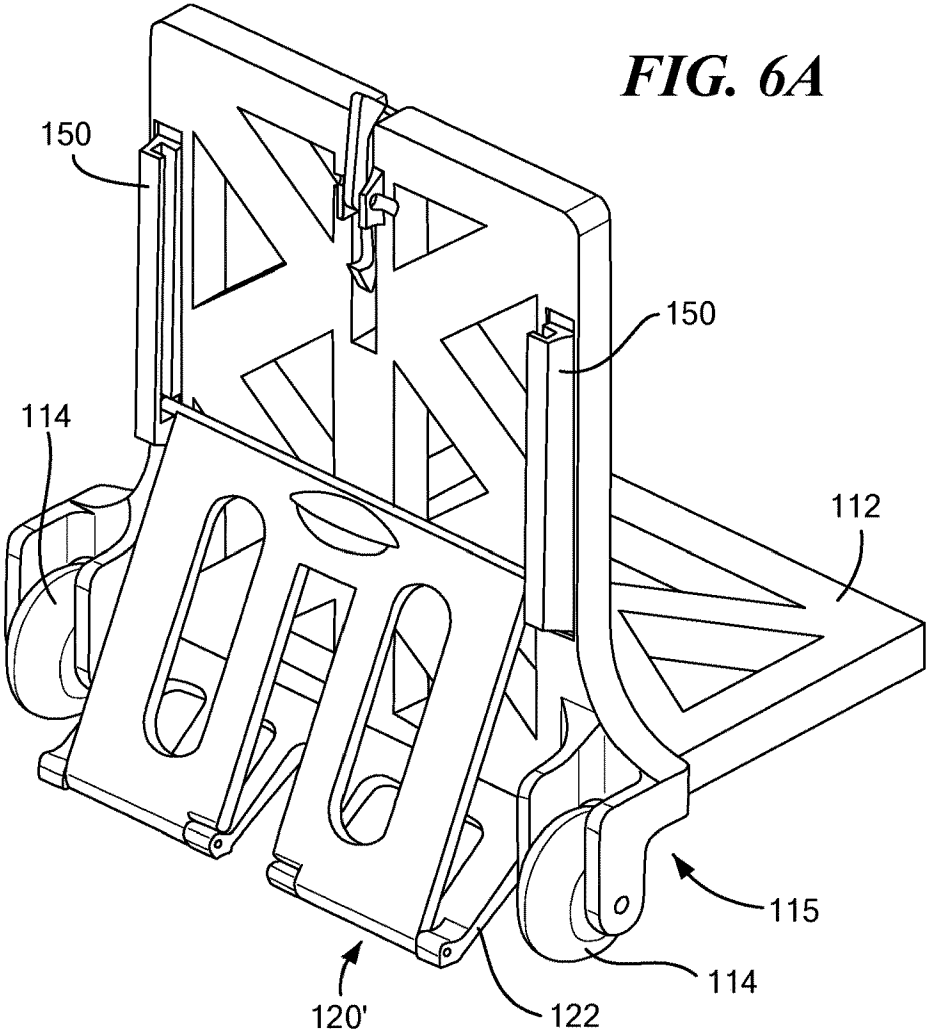

FIGS. 6A-6B show the retractable stabilizer and frame 115. Referring to FIGS. 6A-6B, the rigid frame 115 engages the enclosure 140 and elongated members 102. Wheels 114 added to the frame maintain the rolling functionality, and improve the pivot point for tipping the enclosure 140 while wheeling it behind the user, also facilitating the stabilizer 120. This frame 115 complements the semi rigid enclosure 140 with wheels 114 and the stabilizer 120 attached to the rigid frame. This adds stiffness and stability to the system, as well as provides a stable mounting location for the stabilizer and wheels.

In FIGS. 6A-6B, the retractable stabilizer is shown in deployed positions. Referring to FIGS. 3A-3C and 6A-6B, the stabilizer 120 attaches to a rearward side of the frame 115 for transitioning to a deployed position 120'. The base 112 may include optional feet 113 at a height corresponding to the wheels 114. Upon deployment, the horizontal member 122 folds down to horizontal or below horizontal (as a "kickstand") for contacting a floor surface and stabilizing the device 100. The base 112 and/or feet 113 complete the stabilization for lateral support on both sides of the elongated members 102.

Figure 7B:
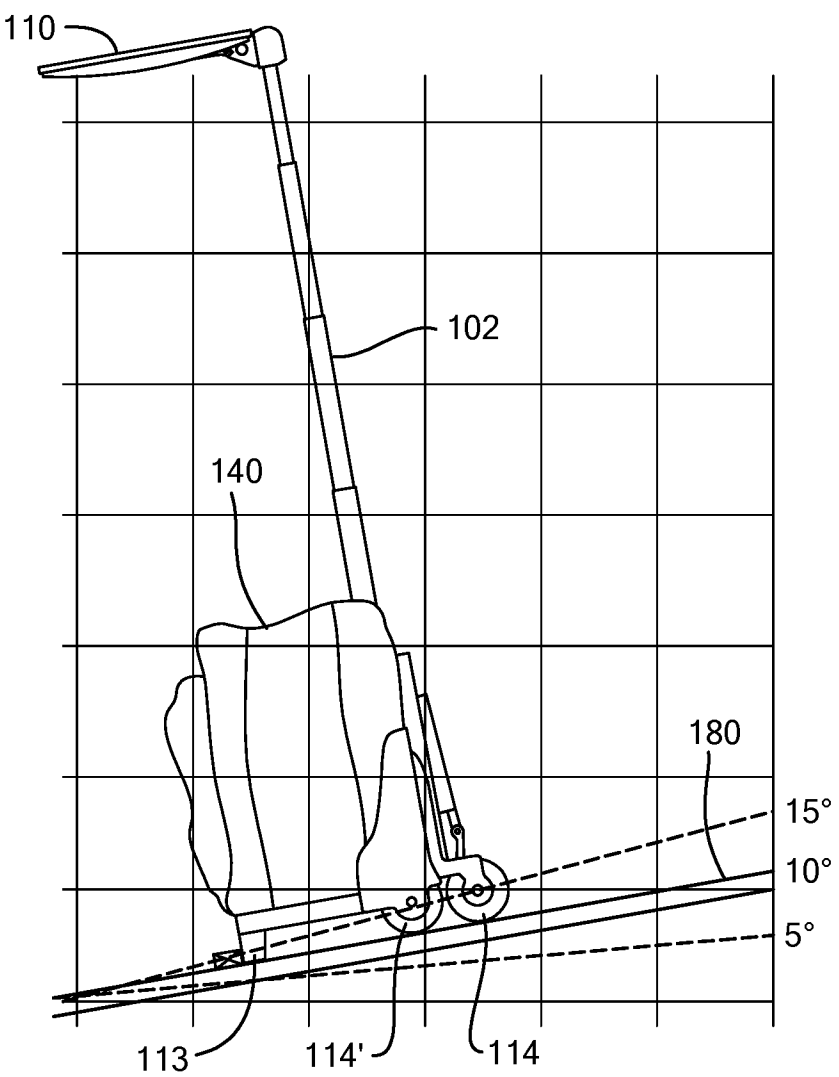
FIGS. 7A-7B show stabilization and tipping tests of the workstation device of FIG. 1.
Figure 7A:
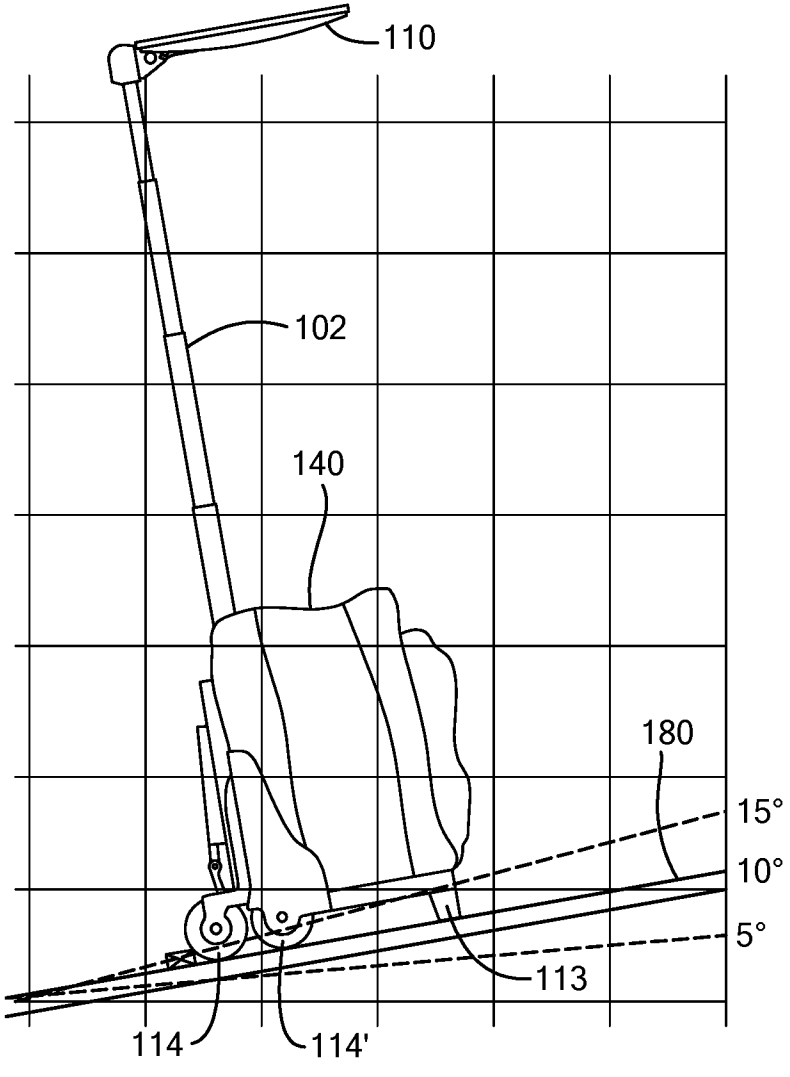

FIGS. 7A-7B show stabilization and tipping tests of the workstation device of FIG. 1. Referring to FIGS. 6A-6B and 7A-7B, tipping of the device is an ongoing hazard with visits in unknown patient homes and/or facilities. As indicated above, the frame 115 is stabilized by the wheels 114 and feet 113, and also by the deployed stabilizer 120'. Collectively the aligned wheels 114 and telescoped handle allow for wheeled portability, and additional hand straps, backpack straps or shoulder straps may be employed for portability of the enclosure when the elongated members are collapsed.

In a medical usage contexts, rolling equipment is relevant to a standard known as IEC-60601-1 which is for medical devices such as rolling carts. A particular benefit of the disclosed approach is compliance with IEC-60601-1 in withstanding a 10 degree incline without toppling or falling over. Referring to FIGS. 7A and 7B, a 1.577 kg weight was placed on the worksurface 110, and an incline 180 of 10 degrees imposed, without the added stability of the stabilizer 120. The device remained upright in both a backward leaning test of FIG. 7A and a forward leaning test of FIG. 5B.

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. A healthcare provider portable workstation device, comprising:

at least one collapsible, elongated member having proximate and distal ends;

a worksurface hingedly attached to the proximate end;

a conveyance vehicle attached at the distal end;

an enclosure configured for receiving the worksurface when the elongated member is in a collapsed orientation; and a containment having a detachable engagement to the elongated member, the containment, when engaged with the elongated member, allows noninterfering hinged movement of the worksurface.

2. The device of claim 1 further comprising a retractable stabilizer at the distal end adapted for extending a stabilizing horizontal member for maintaining a substantially vertical orientation of the elongated member.

3. The device of claim 2 wherein the enclosure and the retractable stabilizer are disposed on opposed sides of the elongated member for horizontal extension of the stabilizer perpendicular to the extended elongated member.

4. The device of claim 2 wherein the retractable stabilizer further comprises:

a slot extending along the elongated member;

a restraint having a pin, the pin slidably engaged in the slot; and a pivoting outrigger, the pivoting outrigger rotatably attached to the distal end and the restraint for pivotal movement to a horizontal position in response to downward movement of the restraint and the pin traveling in the slot.

5. The device of claim 2 further comprising a pair of wheels on the conveyance vehicle, the pair of wheels and the horizontal member defining a plane of contact points, whereby the contact points provide stability.

6. The device of claim 5, further comprising a second pair of wheels extending from the enclosure, the second par of wheels aligned with the plane of contact.

7. The device of claim 1 wherein the containment has a size based on the enclosure for storage therein.

8. The device of claim 1 wherein the worksurface includes an adjustable angular attachment to the elongated member, the angular attachment adjustable between a vertical orientation parallel to the elongated member and a horizontal orientation perpendicular to the elongated member.

9. The device of claim 8 wherein the angular attachment includes a rotatable threaded member for fixing an angular orientation of the worksurface relative to the elongated member.

10. The device of claim 1 further comprising a pair of the elongated members, wherein the detachable engagement includes a pair of opposed compression members biased for frictional engagement with a corresponding pair of the elongated members.

11. The device of claim 10 wherein the compression members are slidably attached to the containment and biased in an opposed direction by respective springs.

12. The device of claim 11 wherein the springs exert a force against the pair of elongated members for frictionally supporting the containment.

13. A healthcare provider portable workstation device, comprising:

at least one collapsible, elongated member having proximate and distal ends;

a worksurface hingedly attached to the proximate end, the worksurface including an adjustable angular attachment to the elongated member, the angular attachment adjustable between a vertical orientation parallel to the elongated member and a horizontal orientation perpendicular to the elongated member;

a conveyance vehicle attached at the distal end; and an enclosure configured for receiving the worksurface when the elongated member is in a collapsed orientation, the adjustable angular attachment including a retractable protrusion and a plurality of receptacles, each receptacle of the plurality of receptacles corresponding to an angular setting.

14. The device of claim 13 wherein the retractable protrusion is spring biased.

15. The device of claim 13 wherein the retractable protrusion engages a threaded member for advancement and retraction of the protrusion with a receptacle of the plurality of receptacles.

16. The device of claim 13 wherein the retractable protrusion extends from a positioning member, the positioning member slidably attached to an underside of the worksurface.

17. The device of claim 16 further comprising a pair of protrusions extending from corresponding branches of the positioning member, each pair of protrusions adapted to engage a corresponding pair of receptacles at each respective angular setting.

18. A healthcare provider portable workstation system, comprising:

at least one collapsible, elongated member having proximate and distal ends;

a worksurface hingedly attached to the proximate end;

a conveyance vehicle attached at the distal end;

a retractable stabilizer at the distal end adapted for extending a stabilizing horizontal member for maintaining a substantially vertical orientation of the elongated member;

a containment having a detachable engagement to the elongated member, the containment, when engaged with the elongated member, allows noninterfering hinged movement of the worksurface; and an enclosure disposed on the conveyance vehicle and sized for receiving the worksurface and the containment when the elongated member is in a collapsed orientation.

* * * * *